US006619213B2

(12) United States Patent
Militaru et al.

(10) Patent No.: US 6,619,213 B2
(45) Date of Patent: Sep. 16, 2003

(54) COIL TRANSPORTER

(75) Inventors: Dan Militaru, Portland, OR (US); Allan Maltby, New Glasgow (CA); Mariusz Kubik, Swidnica (PL)

(73) Assignee: Greenbrier Germany GmbH, Hamoln (DE)

( * ) Notice: Subject to any disclaimer, the term of this patent is extended or adjusted under 35 U.S.C. 154(b) by 0 days.

(21) Appl. No.: 09/966,173

(22) Filed: Sep. 28, 2001

(65) Prior Publication Data

US 2003/0061961 A1 Apr. 3, 2003

(51) Int. Cl.[7] ..... B61D 17/00; B60P 7/12
(52) U.S. Cl. ..... 105/404; 410/47; 410/49
(58) Field of Search ..... 105/238.1, 355, 105/396, 404; 410/47, 49, 50

(56) References Cited

U.S. PATENT DOCUMENTS 3,595,177 A * 7/1971 Bennett et al. ..... 105/377.09
5,170,717 A * 12/1992 Richmond et al. ..... 105/377.09
5,622,116 A * 4/1997 Carlton ..... 105/355
6,363,864 B1 * 4/2002 Jamrozy et al. ..... 105/355

* cited by examiner

*Primary Examiner*—S.. Joseph Morano
*Assistant Examiner*—Robert J. McCarry, Jr.
(74) *Attorney, Agent, or Firm*—Woodcock Washburn LLP

(57) ABSTRACT

The loading troughs 11, 12, 13 of the coil transporter are formed by transverse supports 17, 18, 19 connected to the longitudinal supports 3, 4 of the undercarriage 1. The trough-forming transverse supports are U-shaped supports which are covered by a trough sheet 20 for bearing the coils 14, 15, 16. Together with the covering sheet, they form hollow bodies, which are preferably stiffened with transverse ribs 24. With these trough-forming transverse supports, it is possible for the admissible bearing load of the transporter, with the unloaded weight being the same or reduced, to be increased. Furthermore, the production is simplified on account of a smaller number of connection locations.

44 Claims, 3 Drawing Sheets

COIL TRANSPORTER

DESCRIPTION

The invention relates to a transporter for transporting sheet-metal rolls, which also referred to an coils. Such coil transporters are also known as Shimmns transporters.

The known coil transporters generally have an undercarriage with 2-axle bogies. Fixed end walls and a tarpaulin roof for the loading space. The tarpaulin roof has trolleys which run, via running rollers, on running rails on the undercarriage. For loading and unloading the transporter, the trolleys can be displaced toward the end walls of the tarpaulin roof, with the result that the loading area of the undercarriage is accessible from the top and side.

The undercarriage of the known coil transporters is generally a stable welded frame structure made of rolled profiles and metal sheets.

For transporting the coils, the transporters have troughs, of which the opening angles correspond to the diameter of the coils which are to be loaded. The coil troughs are lined with metal sheets which are supported by angled metal sheets. The angled metal sheets, which extend downwards from the trough sheets, form an open load-bearing structure, i.e. a load-bearing structure without hollow profiles.

The object of the invention is for the admissible bearing load of the coil transporter, with the unloaded weight being the name or reduced, to be increased.

This object is achieved according to the invention by the features specified in patent claim 1.

In the case of the coil transporters according to the invention, the load-bearing structure of the coil troughs is formed by U-shaped transverse supports which are covered by a trough sheet for bearing the coils. A U-shaped transverse support is understood, in this context, as being any support which has a central leg and two lateral legs. It is immaterial whether the angle between the central leg and the lateral legs is a right angle. It is also possible for the lateral legs to be of different lengths. The only critical factor is for the U-shaped transverse supports, together with the trough sheet, to form a closed load-bearing structure, i.e. a load-bearing structure with hollow profiles.

With the improved load-bearing structure of the coil trough, the admissible bearing load is increased, while the empty weight can even be reduced further. The welding-heat absorption is also reduced, as a result of which the steel properties can be largely maintained. The transverse supports reduce stress concentration and the deformation potential.

On account of the smaller number of connection locations, the U-shaped transverse supports simplify the production of the transporter. Only in each case two connection locations per support are necessary in order to connect the transverse supports to the covering sheet.

With the same admissible bearing load, the number of transverse supports for forming the coil troughs may be smaller than the number of angled metal sheets which support the coil troughs of the known transporters.

In a preferred embodiment of the transporter, longitudinal ribs are inserted into the trough-forming transverse supports to provide further reinforcement, these longitudinal ribs being arranged at equal distances from one another.

For transporting coils of different diameters, the trough-forming transverse supports form coil troughs with a different opening angle. In accordance with the diameter of the coils which are to be loaded, this opening angle is, for example, between 3° and 45°.

The load-bearing structures of the trough-forming transverse supports, which form coil troughs with different opening angles, preferably have different cross-sectional surface areas. These are adapted to the different diameters of the coils. It is preferable for the transverse supports of a coil trough with a relatively large opening angle to have a greater cross-sectional surface area than the supports of a trough with a relatively small angle.

The load-bearing structure of a coil trough for relatively small coils is preferably formed in each case by two transverse supports, whereas the load-bearing structure for relatively large coils is preferably formed in each case by four supports. If the trough is formed by four transverse supports, the cross-sectional surface area of the latter may be smaller than the cross-sectional surface area of the supports of a coil trough with only two supports.

In the case of a particularly preferred embodiment, the longitudinal supports have a vertical web with a horizontal bottom flange, which extends to both sides of the web, and a horizontal side flange, which only extends outward. In order to provide further stiffening, it is preferably the case that connected to the webs of the longitudinal supports are lateral reinforcement sheets, which are arranged above the side flanges. In contrast to the longitudinal supports of the know transporters, which have reinforcement sheets on the side flanges, the torsional loading of the longitudinal supports according to the invention in lower on account of the improved geometry. For further stiffening, transverse ribs are preferably inserted between the side flange and bottom flange of the longitudinal supports.

For the trolleys of the tarpaulin roof, single-part guide rails are preferably fitted on the side flanges of the longitudinal supports, with the result that the number of parts which are to be connected to the longitudinal supports is further reduced.

An exemplary embodiment of the invention is explained in more detail hereinbelow with reference to the drawings, in which.

Figure 1:
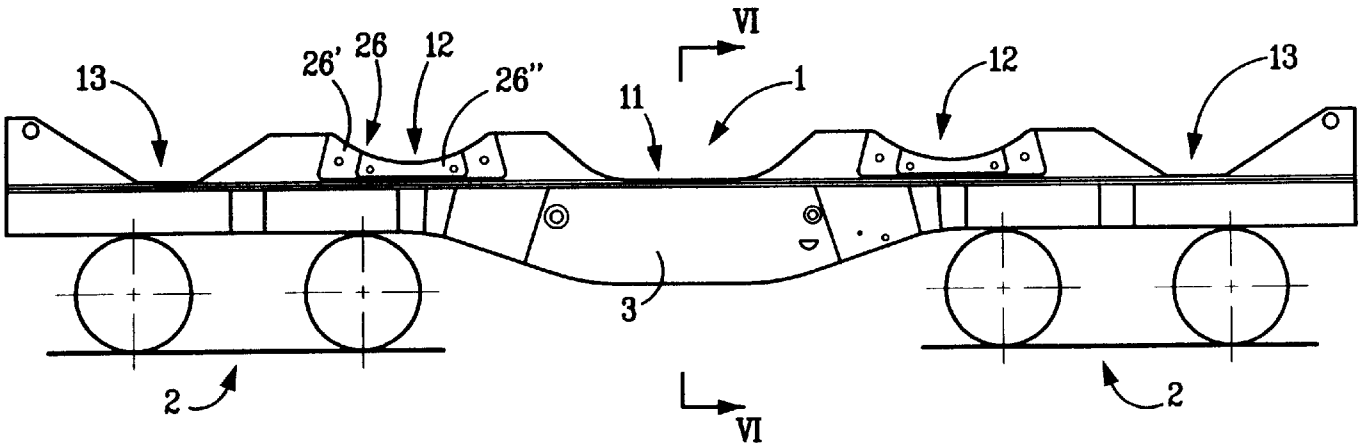
FIG. 1 shows a side view of the undercarriage of a coil transporter.
Figure 2:
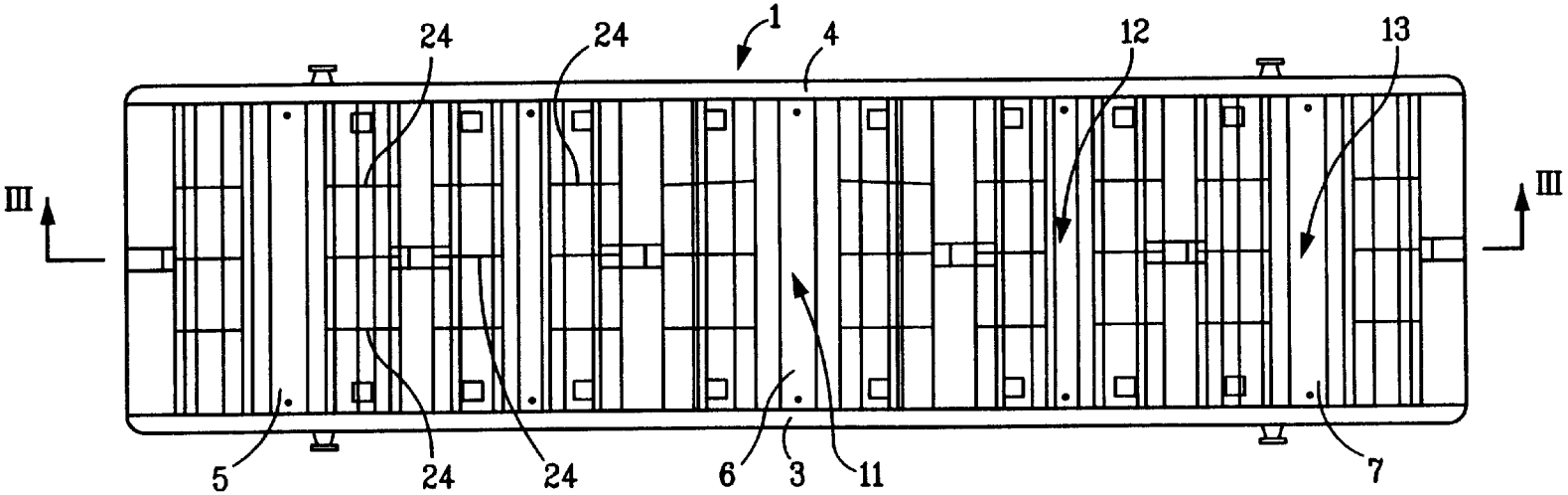
FIG. 2 shows a plan view of the undercarriage from FIG. 1.

FIG. 1 shows a side view of the undercarriage 1 of a coil transporter, the undercarriage resting on two 2-axle bogies 2. The bogies are only indicated in FIG. 1. To improve clarity, the conventional tarpaulin roof with the trolleys is not illustrated. It is likewise the case that the pulling and pushing arrangement is not illustrated. The undercarriage 1 is a stable welded frame structure. It has two parallel longitudinal supports 3, 4, which are connected by main transverse supports 5, 6, 7 (FIG. 2).

The two outer longitudinal supports 3, 4 are of fish-bellied configuration. They each have a vertical web 8 with a bottom flange 9, which extends in the inward and outward directions, and a side flange 10, which only extends outward.

Figure 6:
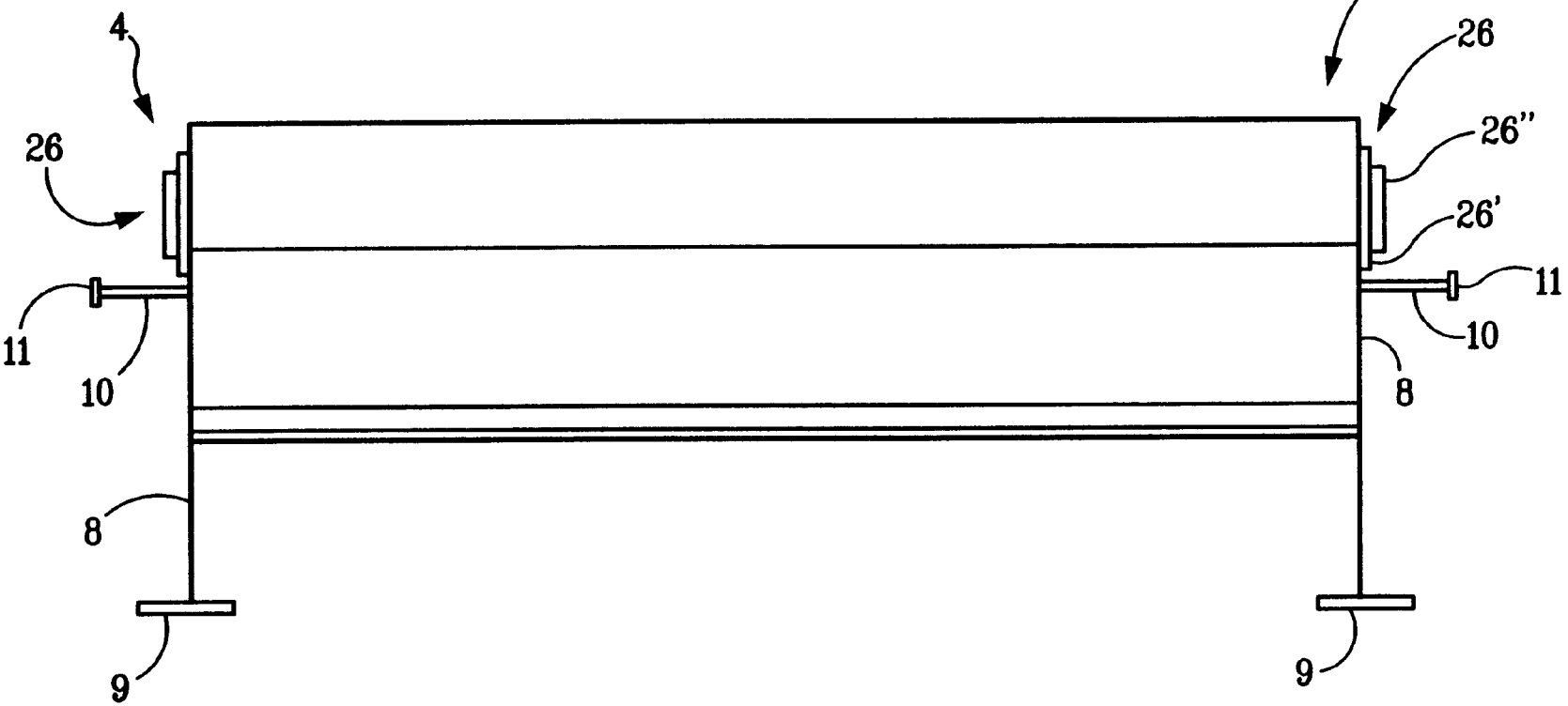
FIG. 6 shows a section through the undercarriage along line VI—VI from FIG. 1.

The bottom flange 9 and side flange 10 each enclose a right angle with the web 8. Welded to the free end of the sides flange 10 is a single-part guide rail 11, on which the rollers of the trolleys (not illustrated) of the tarpaulin roof run (FIG. 6).

Figure 3:
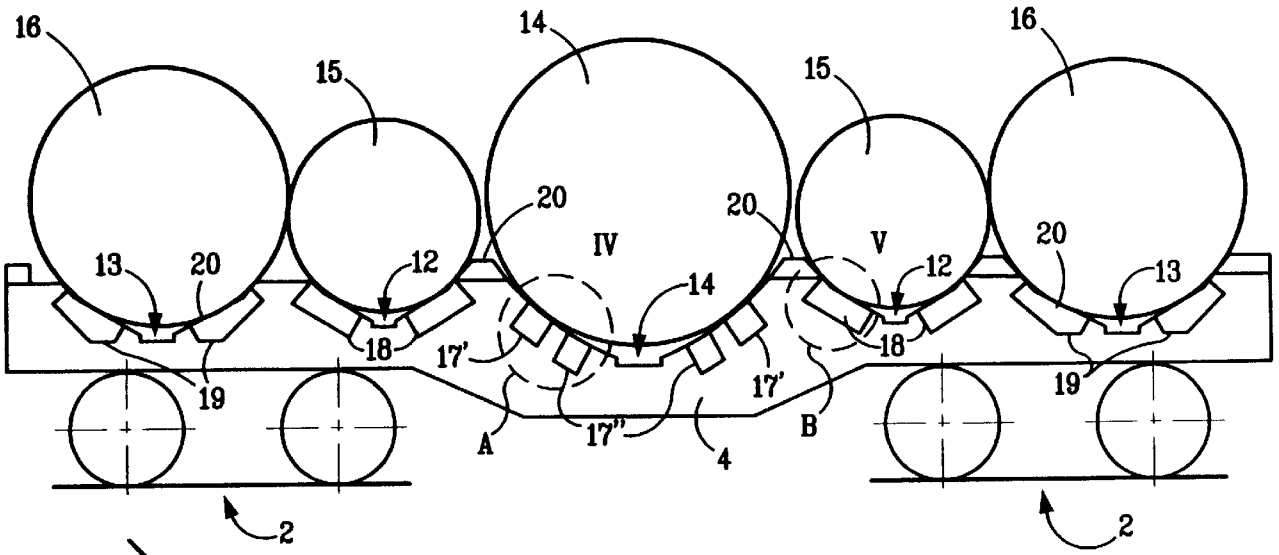
FIG. 3 shows a section through the undercarriage along line III—III from FIG. 2.

The undercarriage has five coil troughs 11, 12, 13 with different opening angles for the coils 14, 15, 16 of different diameters. A central trough 11 is provided for a large coil 14, two inner troughs 12 are provided for small coils 15 and two outer troughs 13 are provided for medium-sized coils 16 (FIG. 3).

The coil troughs 11, 12, 13, are formed by U-shaped transverse supports 17, 17', 18, 19, of which the end sides are welded to the webs 8 of the longitudinal supports 3, 4. While the central trough 11 is formed by four transverse supports 17', 17", in each case two transverse supports 18, 19 are provided for the inner and outer troughs 12, 13. The U-shaped transverse supports are covered by an angled trough sheet 20. Together with the trough sheet 20, transverse supports 17', 17", 18, 19 form a hollow body in each case.

Figure 4:
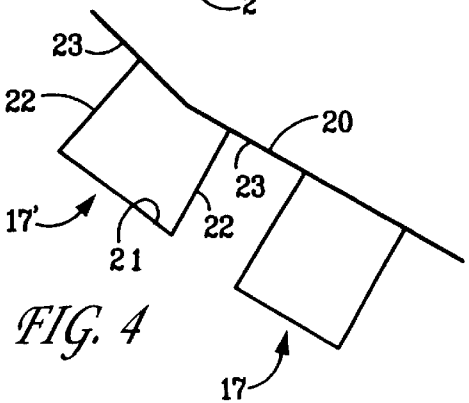
FIG. 4 shows an enlarged illustration of the detail A from FIG. 3.

FIG. 4 shows an enlarged illustration of the two lateral transverse supports 17', 17" of the central coil trough 11. The transverse supports have a central leg 21 and two lateral legs 22, which are angled outward. The angled end sections 23 of the lateral legs 22 are welded to the trough sheet 20. FIG. 4 shows that the two transverse supports 17', 17" differ from one another in terms of the length of the legs and the angles of the latter in relation to one another. These are adapted optimally to the diameter of the coil 14.

Figure 5:
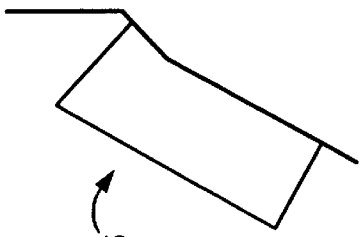
FIG. 5 shows an enlarged illustration of the detail B from FIG. 3.

FIG. 5 shows an enlarged illustration of the lateral transverse support 18 of the inner coil trough 12. This transverse support has a greater cross-sectional surface area than the supports 17', 17" of the central trough 11. It extends largely over the entire lateral flank of the trough sheet 20. The transverse supports 19 of the outer coil trough 16 have an eve greater cross-sectional surface area, this being adapted, in turn, to the larger coil diameter.

In each case three longitudinal ribs 24 arranged at equal distances from one another are welded to the legs of each transverse support and the covering sheet. Furthermore, traverse ribs 25 are welded to the web 8 and the side and bottom flanges 9, 10 of each longitudinal support 3, 4. In order to provide further stiffening, use is also made of lateral reinforcement sheets 26, which are welded to the web 8 of each longitudinal support 3, 4 in the region of the central coil trough 11. The reinforcement sheets 26 each comprise two sub-sheets 26', 26" which are located ore above the other and connected to one another. These are connected to the webs of the longitudinal supports above the side flange 10 (FIG. 6).

What is claimed is:

1. A coil transporter with an undercarriage (1) which is designed as a frame with two parallel longitudinal supports (3, 4), transverse supports (17', 17"; 18, 19) being connected to the longitudinal supports and forming a load-bearing structure of coil troughs (11, 12, 13), the trough-forming transverse supports being U-shape supports (17', 17"; 18, 19) which are covered with a trough sheet (20) for bearing the coils, wherein the trough-forming transverse supports have a central leg and two lateral legs, which are angled outward, the lateral legs being welded to the trough sheet, and wherein longitudinal ribs (24) are inserted into the trough-forming transverse supports (17', 17"; 18, 19).

2. The coil transporter as claimed in claim 1, wherein the longitudinal ribs (24) of a trough-forming transverse support (17', 17"; 18, 19) are arranged at equal distances from one another.

3. The coil transporter as claimed in 1 or 2, wherein the trough-forming transverse supports (17', 17"; 18, 19) form coil troughs (11, 12, 13) with different opening angles.

4. The coil transporter as claimed in 1 or 2, wherein the load-bearing structures of the trough-forming transverse supports (17', 17"; 18, 19), which form coil troughs (11, 12, 13) with different opening angles, have different cross-sectional surface areas.

5. The coil transporter as chimed in claim 1 or 2, wherein in each case two trough-forming transverse supports (18, 19) form a load-bearing structure of a coil trough (12, 13).

6. The coil transporter as claimed in claim 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle.

7. The coil transporter as claimed in 1 or 2, wherein in each case four trough-forming transverse supports (17', 17") form a load-hearing structure of a coil trough (11).

8. The coil transporter as claimed in claims 1 or 2, wherein the longitudinal supports (3, 4) have a web (8) with a bottom flange (9), which extends to both sides of the web, and an outwardly extending side flange (10).

9. The coil transporter as claimed in claims 1 or 2, wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10).

10. The coil transporter as claimed in claim claims 1 or 2, wherein transverse ribs (25) are inserted between the side flange (10) and bottom flange (9) of the longitudinal supports (3, 4).

11. The coil transporter as claimed in claims 1 or 2, wherein in each case one single-piece guide rail (11) is fined on the side flange (10) of the longitudinal supports (3, 4).

12. The coil transporter as claimed in 1 or 2, wherein the trough-forming transverse supports (17', 17"; 18, 19) form coil troughs (11, 12, 13) with different opening angles, and wherein the load-bearing structures of the trough-forming transverse supports (17', 17"; 18, 19), which form coil troughs (11, 12, 13) with different opening angles, have different cross-sectional surface areas.

13. The coil transporter as claimed in claim 1 or 2, wherein the trough-fanning transverse supports (17', 17"; 18, 19) form coil troughs (11, 12, 13) with different opening angles, and wherein the load-bearing structures of the trough-forming transverse supports (17', 17"; 18, 19), which form coil troughs (11, 12, 13) with different opening angles, have different cross-sectional surface areas, and wherein in each case two trough-forming transverse supports (18, 19) form a load-bearing structure of a coil trough (12, 13).

14. The coil transporter as claimed in claim 1 or 2, wherein the load-bearing structures of the trough-forming transverse supports (17', 17"; 18, 19), which form coil troughs (11, 12, 13) with different opening angles, have different cross-sectional surface areas, and wherein in each case two trough-forming transverse supports (18, 19) form a load-bearing structure of a coil trough (12, 13) and wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein in each case two trough-forming transverse supports (18, 19) form a load-bearing structure of a coil trough (12, 13).

15. The coil transporter as claimed in claims 1 or 2, wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10).

16. The coil transporter as claimed in claims 1 or 2, wherein the load-bearing structures of the trough-forming transverse supports (17', 17"; 18, 19), which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10).

17. The coil transporter as claimed in claims 1 or 2, wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10).

18. The coil transporter as claimed in claims 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein the longitudinal supports (3, 4) have a web (8) with a bottom flange (9), which extends to both sides of the web, and an outwardly extending side flange (10).

19. The coil transporter as claimed in claims 1 or 2, wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10).

20. The coil transporter as claimed in claims 1 or 2, wherein the trough-forming transverse supports (17', 17"; 18, 19) form coil troughs (11, 12, 13) with different opening angles, and wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10).

21. The coil transporter as claimed in claims 1 or 2, wherein the load-bearing structures of the trough-forming transverse supports (17', 17"; 18, 19), which form coil troughs (11, 12, 13) with different opening angles, have different cross-sectional surface areas, and wherein the load-bearing structures of the trough-forming transverse supports (17', 17"; 18, 19),which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10).

22. The coil transporter as claimed in claims 1 or 2, wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10).

23. The coil transporter as claimed in claims 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein the longitudinal supports (3, 4) have a web (8) with a bottom flange (9), which extends to both sides of the web, and an outwardly extending side flange (10).

24. The coil transporter as claimed in claims 1 or 2, wherein in each case four trough-fanning transverse supports (17', 17") form a load-bearing structure of a coil trough (11), and wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10).

25. The coil transporter as claimed in claims 1 or 2, wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10), and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4).

26. The coil transporter as claimed in claims 1 or 2, wherein the load-bearing structures of the trough-forming transverse supports (17', 17"; 18, 19), which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4).

27. The coil transporter as claimed in claims 1 or 2, wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4).

28. The coil transporter as claimed in claims 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (2) with a relatively small opening angle, and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4).

29. The coil transporter as claimed in claims 1 or 2, wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4).

30. The coil transporter as claimed in claims 1 or 2, wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

31. The coil transporter as claimed in claims 1 or 2, wherein the load-bearing structures of the trough-forming transverse supports (17', 17"; 18, 19), which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

32. The coil transporter as claimed in claims 1 or 2, wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

33. The coil transporter as claimed in claims 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (2) with a relatively small opening angle, and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

34. The coil transporter as claimed in claims 1 or 2, wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

35. The coil transporter as claimed in claims 1 or 2, wherein the trough-forming transverse supports (17', 17"; 18, 19) form coil troughs (11, 12, 13) with different opening angles, and wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10), and wherein in each case one single-piece guide rail (11) is fined on she side flange (10) of the longitudinal supports (3, 4).

36. The coil transporter as claimed in claims 1 or 2, wherein the load-bearing structures of she trough-forming transverse supports (17', 17"; 18, 19), which form coil troughs (11, 12, 13) with different opening angles, have different cross-sectional surface areas, and wherein the load-bearing structures of the trough-forming transverse supports (17', 17"; 18, 19) which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10), and wherein in each case one single-piece guide rail (11) is fined on the side flange (10) of the longitudinal supports (3, 4).

37. The coil transporter as claimed in claims 1 or 2, wherein in each case two trough-forming transverse supports (18, 19) form a load-bearing structure of a coil trough (12, 13), and wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

38. The coil transporter as claimed in claims 1 or 2, wherein the cross-sectional surface area of the trough-forming transverse supports (19) of a coil trough (13) with a relatively large opening angle is greater than the cross-sectional surface area of she trough-forming transverse supports (18) of a coil trough (12) with a relatively small opening angle, and wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

39. The coil transporter as claimed in claims 1 or 2, wherein in each case four trough-forming transverse supports (17', 17") form a load-bearing structure of a coil trough (11), and wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10), and wherein in each case one single-piece guide rail (11) is fitted on the side flange (10) of the longitudinal supports (3, 4).

40. The coil transporter as claimed in claims 1 or 2, wherein the trough-forming transverse supports (17', 17"; 18, 19) form coil troughs (11, 12, 13) with different opening angles, and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4), and wherein in each case one single-piece guide rail (11) is fitted on the side flange (10) of the longitudinal supports (3, 4).

41. The coil transporter as claimed in claims 1 or 2, wherein the road-bearing structures of the trough-forming transverse supports (17', 17"; 18, 19), which form coil troughs (11, 12, 13) with different opening angles, have different cross-sectional surface areas, and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4), and wherein in each case one single-piece guide rail (11) is fitted on the side flange (10) of the longitudinal supports (3, 4).

42. The coil transporter as claimed in claims 1 or 2, wherein in each case two trough-forming transverse supports (18, 19) form a load-bearing structure of a coil trough (12, 13), and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4), and wherein in each case one single-piece guide rail (11) is fitted on the side flange (10) of the longitudinal supports (3, 4).

43. The coil transporter as claimed in claims 1 or 2, wherein the cross-sectional surface area of the trough-forming transverse supports (19) of a coil trough (13) with a relatively large opening angle is greater than the cross-sectional surface area of the trough-forming transverse supports (18) of a coil trough (12) with a relatively small opening angle, and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4), and wherein in each case one single-piece guide rail (11) is fitted on the side flange (10) of the longitudinal supports (3, 4).

44. The coil transporter as claimed in claim 1 or 2, wherein in each case four trough-forming transverse supports (17', 17") form a load-bearing structure of a coil trough (11), and wherein the longitudinal supports (3, 4) have a web (8) with a bottom flange (9), which extends to both sides of the web, and an outwardly extending side flange (10), and wherein connected to the web (8) of the longitudinal supports (3, 4) are lateral reinforcement sheets (26), which are arranged above the side flanges (10), and wherein transverse ribs (25) are inserted between the side flange (10) and bottom flange (9) of the longitudinal supports (3, 4), and wherein in each case one single-piece guide rail (11) is fitted on the side flange (10) of the longitudinal supports (3, 4).

* * * * *

UNITED STATES PATENT AND TRADEMARK OFFICE

CERTIFICATE OF CORRECTION

PATENT NO. : 6,619,213 B2
DATED : September 16, 2003
INVENTOR(S) : Militaru et al.

It is certified that error appears in the above-identified patent and that said Letters Patent is hereby corrected as shown below:

Column 1,
Line 5, delete “an” and insert therefor -- as --.
Line 9, delete “for” and insert therefor -- form --.
Line 29, delete “same” and insert therefor -- name --.

Column 2,
Line 30, delete “in” and insert therefor -- is --.

Column 3,
Line 36, delete “eve” and insert therefor -- even --.
Line 41, delete “traverse” and insert therefor -- transverse --.

Column 4,
Lines 1 and 37, after “in” insert -- claims --.
Line 9, delete “chimed” and insert therefor -- claimed --.
Line 19, delete “load hearing” and insert therefor -- load-bearing --.
Line 30, delete “claim”.
Line 35, delete “fined” and insert therefor -- fitted --.
Line 45, delete “trough-fanning” and insert therefor -- trough-forming --.

Column 8,
Lines 7 and 21, delete “fined” and insert therefor -- fitted --.
Lines 10 and 38, delete “she” and insert therefor -- the --.

Column 10,
Line 20, delete “claim” and insert therefor -- claims --.

Signed and Sealed this

Second Day of December, 2003

JAMES E. ROGAN